US005772096A

United States Patent [19]

Osuka et al.

[11] Patent Number: 5,772,096

[45] Date of Patent: Jun. 30, 1998

[54] TRIGGER DEVICE FOR BOX NAILING MACHINE AND BOX NAILING MACHINE HAVING THE SAME

[75] Inventors: Satoshi Osuka; Noboru Ishikawa; Michiaki Adachi; Terufumi Hamano; Youichi Kimura; Hiroshi Hanagasaki, all of Tokyo, Japan

[73] Assignee: Max Co., Ltd., Tokyo, Japan

[21] Appl. No.: 628,465

[22] Filed: Apr. 5, 1996

[30] Foreign Application Priority Data

Apr. 5, 1995 [JP] Japan ..... 7-080614

[51] Int. Cl.[6] ..... B25C 1/06

[52] U.S. Cl. ..... 227/5; 227/2; 227/8; 227/130

[58] Field of Search ..... 227/1, 2, 5, 7, 227/8, 130, 131, 6

[56] References Cited

U.S. PATENT DOCUMENTS

| | | | |
|---|---|---|---|
| 3,964,659 | 6/1976 | Eiben et al. | 227/7 X |
| 4,108,345 | 8/1978 | Manganaro | 227/131 |
| 4,298,072 | 11/1981 | Baker et al. | 227/7 X |
| 4,405,071 | 9/1983 | Austin | 227/7 |
| 4,500,938 | 2/1985 | Dulin | 227/131 X |
| 4,556,803 | 12/1985 | Weigert | 227/131 X |
| 4,679,719 | 7/1987 | Kramer | 227/5 |

*Primary Examiner*—Joseph J. Hail, III
*Assistant Examiner*—Jay A. Stelacone
*Attorney, Agent, or Firm*—Morgan, Lewis & Bockius LLP

[57] ABSTRACT

A box nailing machine includes a piston within a cylinder to drive a nail. A main selector valve introduces compressed air into the cylinder and discharges the compressed air from the cylinder. A start operation valve operates the main selector valve. A trigger device for the box nailing machine comprises: a trigger switch operated by a trigger lever; a contact switch operated by the contact arm; an electromagnetic valve serving as the start operation valve; a logical circuit for applying a drive current to the electromagnetic valve when both the trigger switch and the contact switch are turned on; and a controller which includes a timer with a predetermined time limit. The timer is started in accordance with a trigger signal of the trigger switch and prohibits the drive current from the electromagnetic valve when the timer counts the predetermined time period. The timer is reset upon release of the trigger.

2 Claims, 4 Drawing Sheets

TRIGGER DEVICE FOR BOX NAILING MACHINE AND BOX NAILING MACHINE HAVING THE SAME

BACKGROUND OF THE INVENTION

The present invention relates to a box nailing machine, and more particularly relates to a trigger device of a box nailing machine.

The trigger device of a conventional portable type box nailing machine comprises a trigger lever and a contact arm arranged in a nose portion. While the trigger lever is pulled, one end portion of the contact arm is made to come into pressure contact with a workpiece into which a nail is driven. Then the other end portion of the contact arm pushes up a fore end portion of an arm attached to the trigger lever, so that the arm is entirely pushed up by the trigger lever and the contact arm. Therefore, the arm pushes a valve stem of the start operation selector valve, so that a nail is driven. Accordingly, in an OFF-condition in which the contact arm is not pressed against the object into which a nail is driven, even when the trigger lever is operated, the nail is not driven. The mechanical safety mechanism of the conventional box nailing mechanism is constituted as described above.

Since the box nailing machine is provided with the safety mechanism by the action of which the box nailing machine can not be set into motion when only the trigger lever is operated, when the nailing place is changed, the box nailing machine is frequently carried by an operator under the condition that the trigger lever is pulled by a finger of his hand which is holding the grip of the box nailing machine. At this time, a nail is carelessly driven by the box nailing machine when the contact arm is pushed by some reasons.

In order to prevent the possibility of driving a nail during the movement of an operator so as to enhance the safety, technical problems are discussed here. It is an object of the present invention to solve the above problems.

SUMMARY OF THE INVENTION

The present invention is proposed to accomplish the above object. The present invention is to provide a trigger device of a box nailing machine comprising: a drive mechanism including a piston and cylinder mechanism; a main selector valve for introducing compressed air into the cylinder and discharging it from the cylinder; a start operation valve for operating the main selector valve, the start operation valve including an electromagnetic valve; a trigger lever for supplying a start signal to the start operation valve; a contact arm for supplying a start signal to the start operation valve; a control unit for controlling the electromagnetic valve; a trigger switch interlocked with the trigger lever, the trigger switch being connected to the control unit; a contact switch interlocked with the contact arm, the contact switch being connected to the control unit; a logical circuit constituted in such a manner that the control unit outputs a drive current to the electromagnetic valve when both the trigger switch and the contact switch are turned on; a timer provided in the control unit; a control means for starting the timer in accordance with a trigger signal of the trigger switch; and a control means for stopping the drive current of the electromagnetic valve when the time measured by the timer has reached a reference time.

The present invention is to provide a trigger device of a box nailing machine comprising: a drive mechanism including a piston and cylinder mechanism; a main selector valve for introducing compressed air into the cylinder and discharging it from the cylinder; a start operation valve for operating the main selector valve; a trigger lever for supplying a start signal to the start operation valve; a contact arm for supplying a start signal to the start operation valve; a mechanical link mechanism including the trigger lever and the contact arm, wherein the start operation valve for operating the main selector valve mechanism is changed over so that the box nailing machine can be started when the trigger lever and the contact arm are simultaneously operated; a solenoid drive type lock pin capable of engaging with the contact arm; a switch interlocked with the trigger lever; a timer connected to the switch; a control means for starting the timer in accordance with an ON-signal of the switch; and a control means for outputting a drive current to a lock pin drive solenoid in accordance with the time measured by the timer, wherein the drive current is outputted to the lock pin drive solenoid when the time measured by the timer has reached a reference time, so that the lock pin is engaged with the contact arm, and the contact arm is locked at a waiting position.

According to the trigger device of the invention, when the trigger lever of the box nailing machine is pulled, the trigger switch is changed over, and the timer starts measuring the time. When the contact arm is made to come into pressure contact with an object into which a nail is driven before the time measured by the timer reaches the reference time, both the trigger switch and the contact switch are turned on and the start operation electromagnetic valve is changed over, so that a nail is driven. When the time measured by the timer reaches the reference time under the condition that the trigger switch is turned on and the contact switch is turned off, an output of the electromagnetic valve drive current is prohibited, and the drive current is not outputted until the trigger switch is turned off or an reset operation is conducted by a reset means.

According to the trigger device of the invention, when the trigger lever of the box nailing machine is pulled, the timer starts measuring the time in accordance with a signal sent from the switch interlocked with the trigger lever. When the trigger lever is turned off, the timer is reset. When the trigger lever is turned on for a predetermined period of time and the time measured by the timer reaches the reference time, the control circuit outputs a drive signal to the solenoid drive type lock pin, so that the lock pin is engaged with the contact arm, which is locked at the OFF-position.

DETAILED DESCRIPTION OF THE PREFERRED EMBODIMENTS

Figure 1:
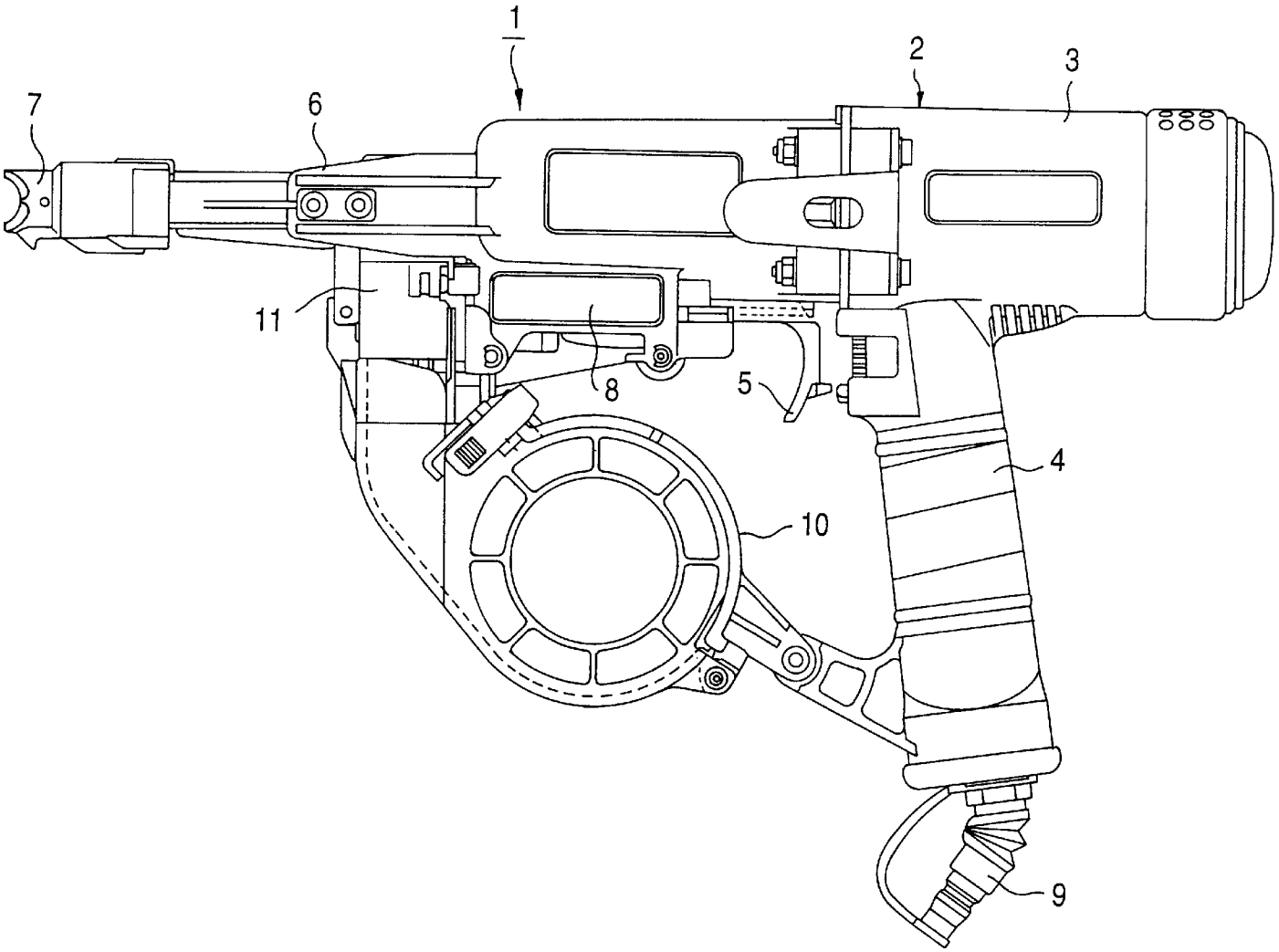
FIG. 1 is a side view of a box nailing machine of an embodiment of the present invention.

Referring to the accompanying drawings, an embodiment of the present invention will be explained below. FIG. 1 is a view showing a pneumatic drive type box nailing machine 1 of the present invention. The casing 2 includes a mechanism housing 3 and a grip portion 4, in which an air chamber is formed, wherein the mechanism housing 3 and the grip portion 4 are integrated with each other. The mechanism housing 3 includes an air cylinder. On a lower face of the mechanism housing 3, there is provided a trigger lever 5 capable of freely sliding. There is provided a contact arm 7 on an outer circumference of the nose portion 6.

In a trigger housing 8 arranged in the front of the trigger lever 5, there are provided a trigger switch, contact switch, start control unit and start operation electromagnetic valve. A slider portion of the trigger lever 5 and an end of the contact arm 7 extend into the trigger housing 8. Therefore, when the trigger lever 5 is operated, the trigger switch is turned on, and when the contact arm 7 is made to come into pressure contact with a workpiece into which a nail is driven, the contact switch is turned on.

There is provided an air coupling 9 at an end of the grip portion 4. The air coupling 9 is connected with an air compressor via an air hose. There is provided a nail magazine 10 between the nose portion 6 and the grip portion 4. Connected nails charged in the nail magazine 10 are successively fed to the nose portion 6 by a nail feed mechanism 11.

Figure 2:
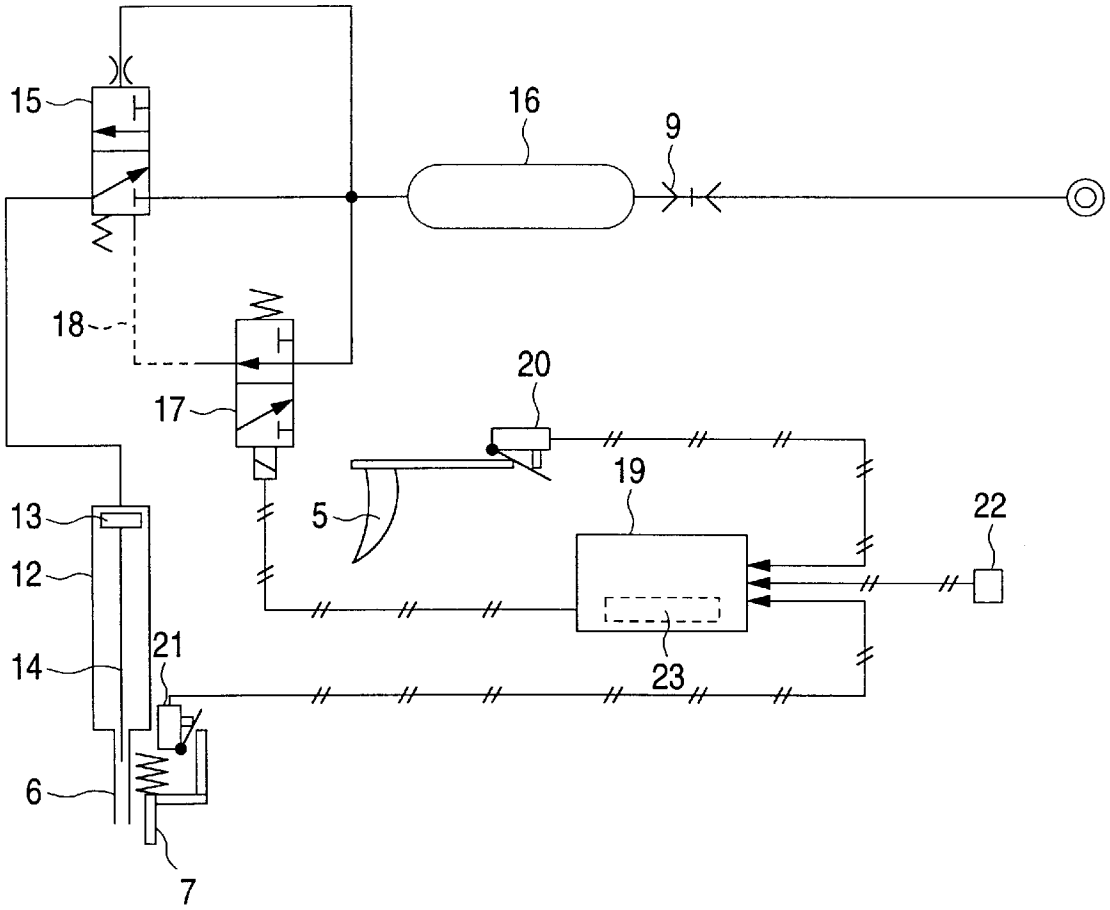
FIG. 2 is a circuit diagram of the trigger device of the invention.

FIG. 2 is a view showing a circuit of the trigger device. A driver rod 14 is connected to a piston 13 provided in an air cylinder 12 of the box nailing machine 1. The driver rod 14 moves downward in the nose portion 6 and drives a nail provided in the nose portion 6. In this case, an upper end of the air cylinder 12 is open to an air pipe. When a main selector valve 15 attached to an upper end opening of the air cylinder 12 moves in the upward and downward direction, the air cylinder 12 is connected to or separated from an air chamber 16. On an upper face of the main selector valve 15 (on a lower face of the main selector valve 15 in FIG. 2), air pressure in the air chamber 16 acts via a start operation electromagnetic valve 17 (referred to as an electromagnetic valve in this specification hereinafter) and a pilot path 18. Since a pressure receiving face area on the upper face of the main selector valve 15 is larger than a pressure receiving face area on the lower face (the upper face in FIG. 2) of the outer peripheral portion, the primary selector valve 15 separates the air cylinder 12 from the air chamber 16 due to a pressure difference between the upper and the lower face, so that the air cylinder 12 is communicated with the atmosphere.

When the control unit 19 outputs an electromagnetic valve drive current, the electromagnetic valve 17 is operated, so that the pilot path 18 is communicated with the atmosphere and the compressed air for controlling the main selector valve 15 is discharged from the main selector valve 15. Then, the pressure in the main selector valve 15 is increased by the pressure in the air chamber 16, so that the air chamber 16 is communicated with the air cylinder 12, and the piston 13 is driven downward by the air of high pressure in the air chamber 16 so that a nail provided in the nose portion 6 can be driven.

The control unit 19 is connected to a trigger switch 20, a contact switch 21 and a selector switch 22 for selecting between the singly driving mode and the continuously driving mode. The control unit 19 is constituted in such a manner that it conducts an AND operation in which an electromagnetic valve drive current is outputted when both the trigger switch 20 and the contact switch 21 are turned on. The control unit 19 is provided with a timer 23 for measuring the ON time of the trigger switch 20 in which the trigger switch 20 is turned on. There is provided a safety function by which the electromagnetic valve drive current is stopped in accordance with the ON time of the trigger switch 20.

Figure 3:
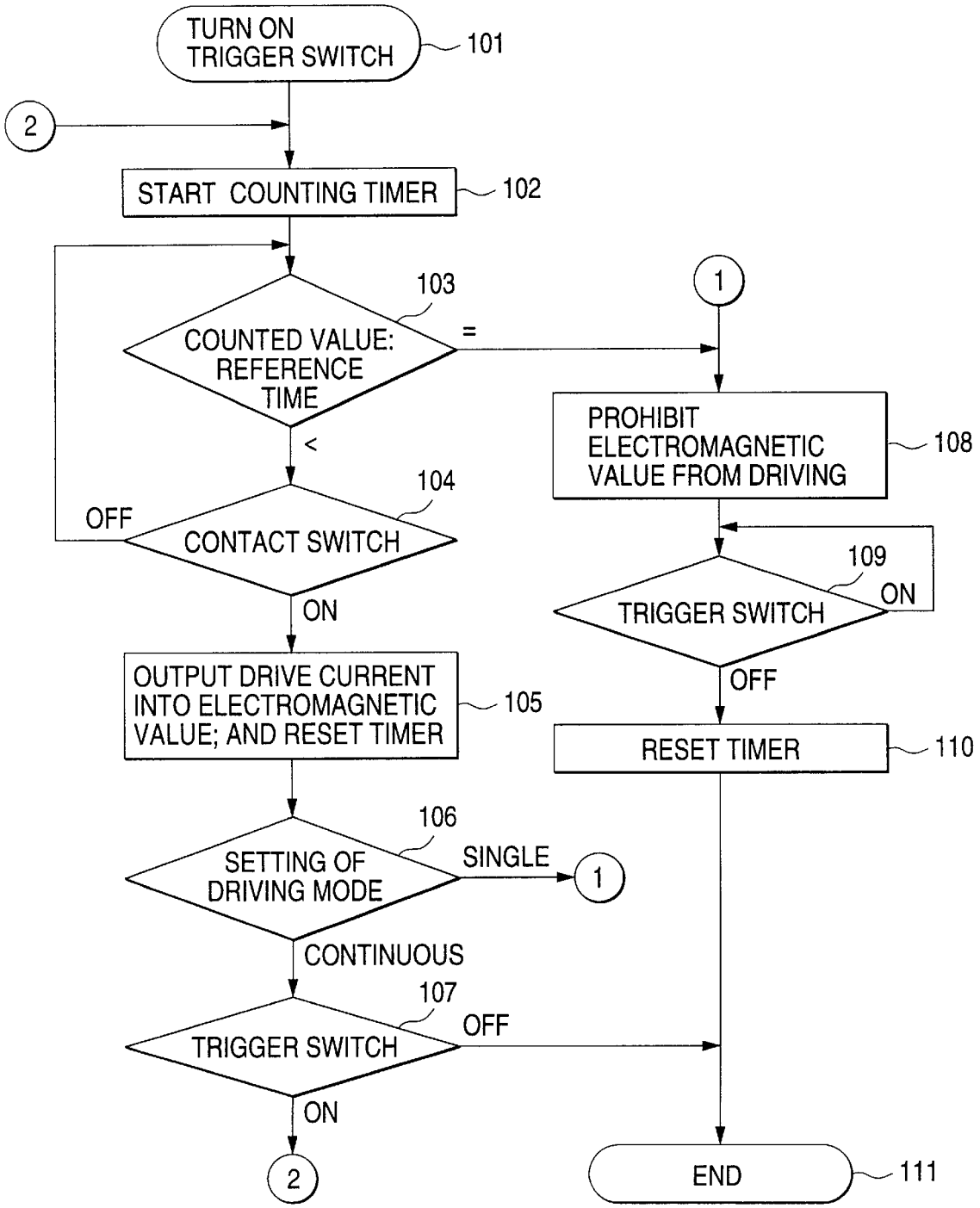
FIG. 3 is a flow chart of driving a nail conducted by the trigger device shown in FIG. 2.

Referring to a flow chart shown in FIG. 3, a flow of the electromagnetic valve control will be explained as follows. First, when the trigger lever 5 is pulled, the trigger switch 20 is turned on (step 101), and the timer 23 starts counting (step 102). A comparison is made between the counted value and the reference time that has been previously set (step 103). The contact arm 7 is pushed to a workpiece into which a nail is driven before the counted value reaches the reference time and then the contact switch 21 is turned on (step 104). Then a drive current is outputted into the electromagnetic valve 17 (step 105), so that a nail is driven. At the same time, the counted value of the timer 23 is reset. In the case of the continuously driving mode (step 107), the program returns to step 102 when the trigger switch 20 is turned on, and the program is completed when the trigger switch 20 is turned off (step 111).

When the singly driving mode is selected, the program advances from step 106 to step 108, and the electromagnetic valve drive current output prohibition processing is conducted. Due to the above processing, even if the contact arm 7 is made to come into pressure contact again with a workpiece into which a nail is driven, no nail is driven, and the output stop condition is maintained until the trigger switch 20 is turned off (step 109). When the trigger switch is turned off and the output stop condition is released and the timer 23 is reset (step 110), the program is completed (step 111).

Irrespective of the mode that has been set, when the trigger lever 5 is pulled and the trigger switch 20 is turned on under the condition that the contact switch 21 is turned off, a predetermined period of time passes and the passage time reaches the reference time (step 103). Then the drive current is stopped (step 108). Unless the trigger switch 20 is turned off, this output stop condition is continued. Accordingly, when the box nailing machine 1 is carried by an operator, even if the trigger lever 5 is maintained in a condition in which it is pulled, a nail is prohibited from being driven after a predetermined period of time has passed. As a result, even when the contact arm 7 collides with a surrounding object and is pushed by the workpiece, there is no possibility that a nail is driven.

Figure 4:
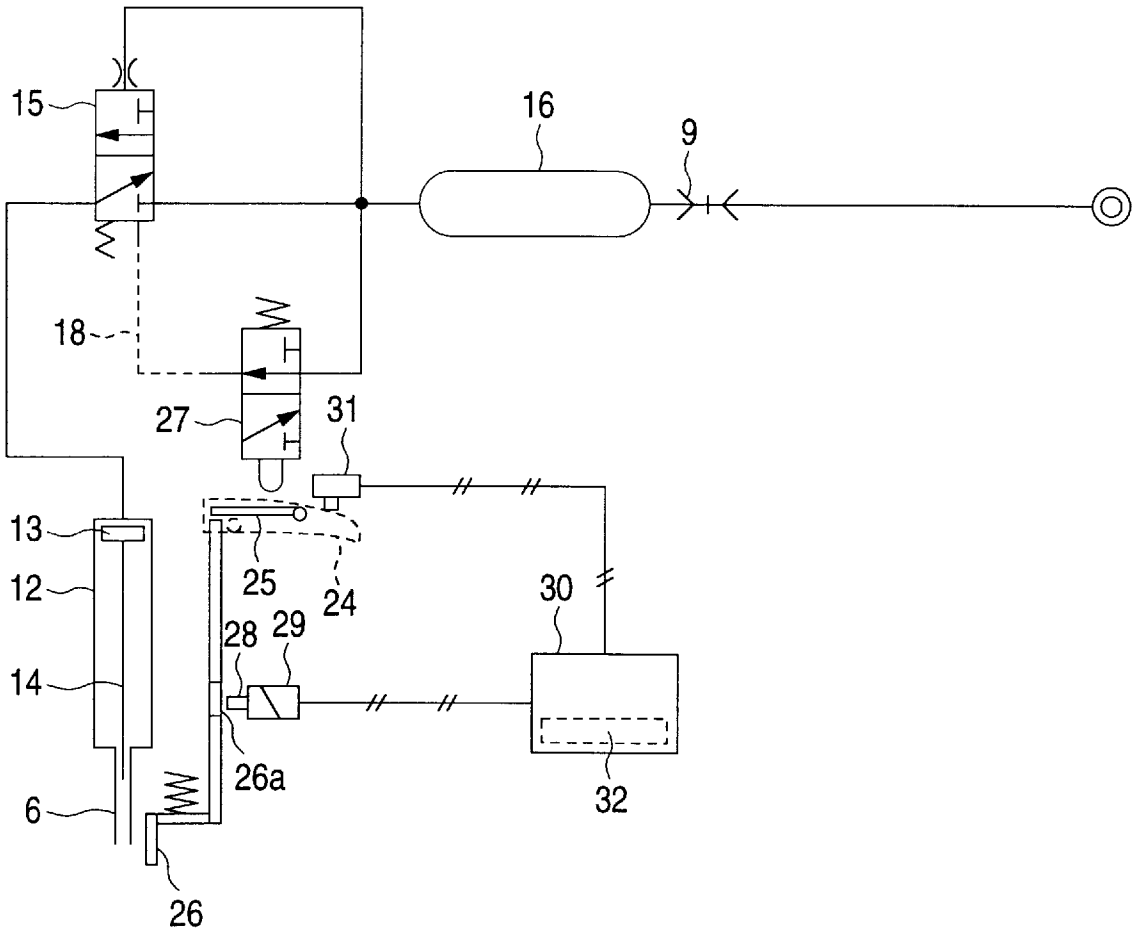
FIG. 4 is another circuit diagram of the trigger device of the invention.

FIG. 4 is a view showing another circuit of the trigger device according to the invention. The structure shown in FIG. 4 is similar to the structure of the mechanical trigger device of the conventional box nailing machine. An upper end portion of the contact arm 26 is opposed to a lower face of the end portion of the free arm 25 attached to the trigger lever 24. When the trigger lever 24 is pulled and the contact arm 26 is made to come into pressure contact with a plate and others, the overall free arm 25 is pushed upward, so that the start operation valve 27 can be changed over.

In the contact arm 26, there is provided a hole **26*a* or a recess, and also there is provided a solenoid drive type lock pin 28 being opposed to the hole 26*a* or the recess. The lock pin drive solenoid 29 is driven by the control unit 30. When the lock pin 28 is protruded, it is engaged with the hole 26*a* of the contact arm 26, and the contact arm 26 is locked at the OFF position. On the reverse side of the trigger lever 24, there is provided a switch 31 interlocked with the trigger lever 24, and the switch 31 is connected to the control unit 30**.

When the trigger lever 5 is pulled, the switch 31 is pushed by the trigger lever 5 and turned on, and the timer 32 of the control unit 30 starts counting. When the operation of the trigger lever 24 is released, the counted value is reset. When a predetermined period of time passes under the condition that the trigger lever 24 is pulled and the counted value reaches a reference time which has been previously set, the control unit 30 outputs a solenoid drive current, and contact arm 26 is locked at the OFF position, so that an erroneous drive of a nail can be prevented in the same manner as that of the trigger device of the first embodiment. The lock condition can be released when the operation of the trigger lever 24 is released and the solenoid drive current is stopped.

In this connection, the present invention is not limited to the above specific embodiment. Variations may be made by one skilled in the art, for example, the start and stop condition may be displayed by a display means such as an LED. It should be noted that the scope of claim of the present invention covers the variations.

The trigger device of a box nailing machine of the invention is arranged as described in the above embodiment. Accordingly, the following effects can be provided. When the nailing machine is carried by an operator under the condition that the trigger lever is pulled, even if the contact arm is made to come into pressure contact with a surrounding object, no nail is driven, that is, there is no possibility of erroneously driving a nail. When intervals of the start of the safety mechanism are set at values longer than the intervals of driving nails in a common nail driving work, it is possible to enhance the safety without causing any problems in the nail driving work.

We claim:

1. A trigger device for a box nailing machine, the box nailing machine including a piston driving a nail, a cylinder accommodating the piston, a main selector valve for introducing compressed air into the cylinder and discharging the compressed air from the cylinder, a start operation valve for operating the main selector valve, a trigger lever and a contact arm, said trigger device comprising:

a trigger switch operated by the trigger lever;

a contact switch operated by the contact arm;

an electromagnetic valve serving as the start operation valve;

a logical circuit for applying a drive current to said electromagnetic valve when both said trigger switch and said contact switch turn on; and control means including a timer having a predetermined time period that begins with a trigger signal of said trigger switch and resets upon release of said trigger switch, said control means prohibiting the drive current from applying to said electromagnetic valve when said timer counts the predetermined time period.

2. A box nailing machine in which a nail is driven into a workpiece using a compressed air, comprises:

a piston driving the nail;

a cylinder accommodating said piston;

a main selector valve for introducing the compressed air into said cylinder and discharging the compressed air from said cylinder;

a start operation valve including an electromagnetic valve, for operating said main selector valve;

a trigger lever having a trigger switch;

a contact arm having a contact switch;

a logical circuit for applying a drive current to said electromagnetic valve when both said trigger switch and said contact switch turn on;

a timer counting a time and having a predetermined time period; and control means for starting said timer in accordance with a trigger signal of said trigger switch and for prohibiting the drive current from applying to said electromagnetic valve when said timer counts the predetermined time period, said control means resetting said timer upon release of said trigger lever.

* * * * *

Adverse Decision In Interference

Patent No. 5,772,096, Satoshi Osuka, Noboru Ishikawa, Michiaki Adachi, Terufumi Hamano, Youichi Kimura, Hiroshi Hanagasaki, TRIGGER DEVICE FOR BOX NAILING MACHINE AND BOX NAILING MACHINE HAVING THE SAME, Interference No. 104,723, final judgment adverse to the patentees rendered October 17, 2001, as to claims 1 and 2.

*(Official Gazette November 13, 2001)*